United States Patent [19]

Müller

[11] Patent Number: 5,064,187

[45] Date of Patent: Nov. 12, 1991

[54] CHAIN CONVEYOR FOR PAPER SHEETS AND THE LIKE

[75] Inventor: Hans Müller, Zofingen, Switzerland

[73] Assignee: Grapha-Holding AG, Hergiswil, Switzerland

[21] Appl. No.: 486,512

[22] Filed: Feb. 28, 1990

[30] Foreign Application Priority Data

Mar. 7, 1989 [CH] Switzerland ..... 843/89

[51] Int. Cl.[5] ..... B65H 29/04

[52] U.S. Cl. ..... 271/204; 271/268; 271/277; 198/803.7; 198/803.9; 198/838; 294/99.1; 101/408

[58] Field of Search ..... 271/204, 206, 277, 268, 271/85; 198/803.7, 803.8, 803.9, 838, 845; 294/99.1; 101/408, 409, 411; 221/218

[56] References Cited

U.S. PATENT DOCUMENTS

| | | | |
|---|---|---|---|
| 2,818,965 | 1/1958 | Hörth | 198/838 |
| 4,320,894 | 3/1982 | Reist et al. | 271/277 |
| 4,381,056 | 4/1983 | Eberle | 294/104 X |
| 4,448,408 | 5/1984 | Faltin | 271/204 X |
| 4,638,906 | 1/1987 | Winiasz | 198/803.9 |
| 4,681,213 | 7/1987 | Winiasz | 198/803.9 |
| 4,721,296 | 1/1988 | Mowry | 198/644 X |
| 4,746,007 | 1/1988 | Houseman | 271/204 X |
| 4,858,752 | 9/1989 | Ballard, Jr. | 198/845 |
| 4,905,818 | 3/1990 | Houseman | 198/803.7 |
| 4,921,294 | 5/1990 | Klopfenstein | 271/204 X |
| 4,953,847 | 10/1990 | Honegger | 271/277 |

FOREIGN PATENT DOCUMENTS

| | | | |
|---|---|---|---|
| 46602 | 2/1966 | Netherlands | 198/803.7 |
| WO8603476 | 7/1984 | PCT Int'l Appl. . | |
| 574364 | 4/1976 | Switzerland | 271/204 |

*Primary Examiner*—H. Grant Skaggs
*Assistant Examiner*—C. Druzbick
*Attorney, Agent, or Firm*—Peter K. Kontler

[57] ABSTRACT

A link chain has alternating first and second links which are articulately connected to each other by universal joints. Each first link carries a gripper with a fixed jaw and a second jaw pivotable between first and second end positions through a dead-center intermediate position. Springs are provided to permanently bias each second jaw to either of the two end positions, and each second jaw is connected with a follower which can track a set of cams at two spaced-apart stations to move the second jaw between its end positions. Each link of the chain carries two shafts for pairs of roller followers which track the lateral edge faces of two flanges of an elongated guide rail having an H-shaped cross-sectional outline. The guide rail is bent and/or twisted, if necessary, to establish a helical, arcuate, looped and/or other complex path for advancement of successive links between the two stations. An additional follower of each link tracks the one or the other flange at one side of the web which connects the flanges of the rail to each other.

16 Claims, 2 Drawing Sheets

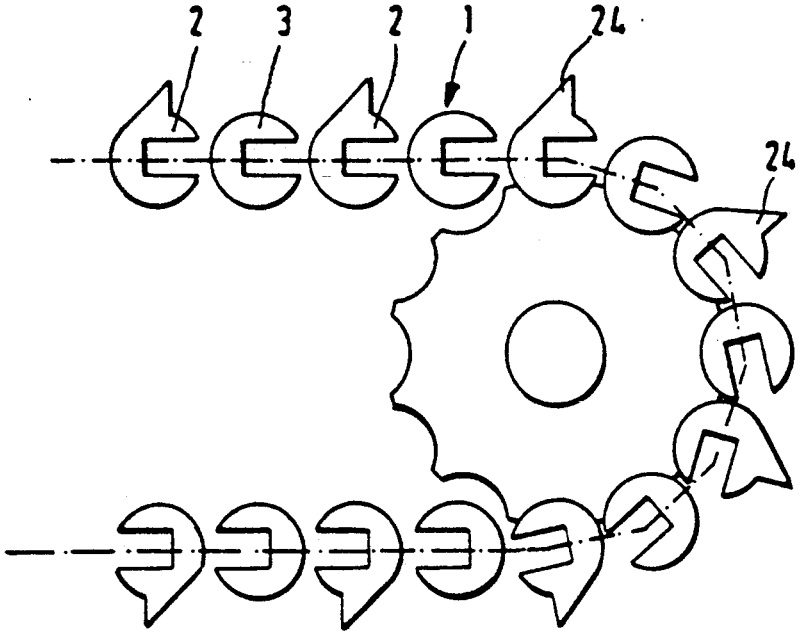
FIG. 1
FIG. 3
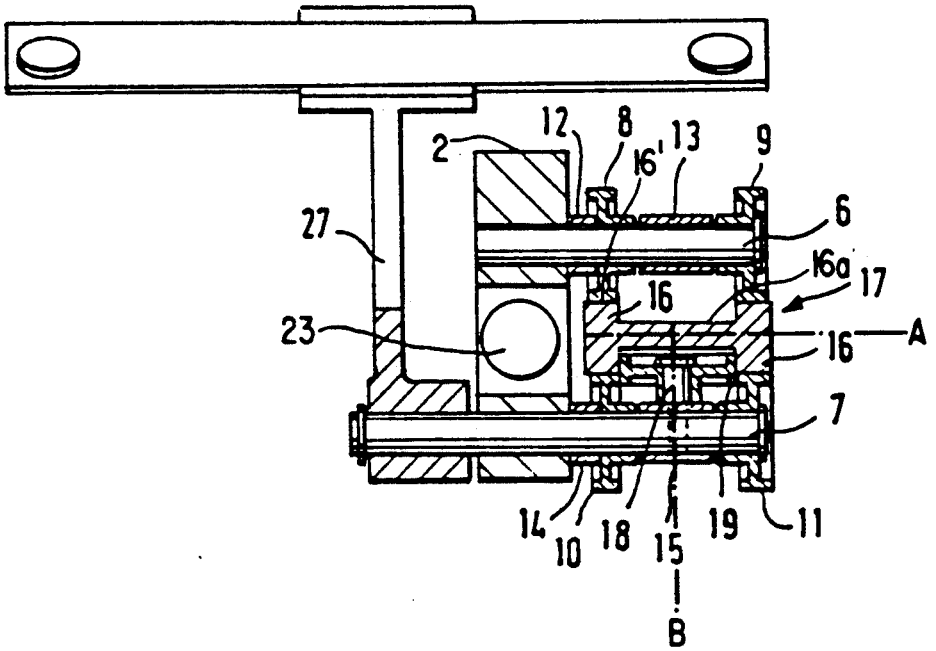

CHAIN CONVEYOR FOR PAPER SHEETS AND THE LIKE

BACKGROUND OF THE INVENTION

The invention relates to conveyors in general, and more particularly to improvements in chain or link conveyors. Still more particularly, the invention relates to improvements in conveyors which can be utilized to transport discrete sheets or groups of two or more (folded or unfolded) sheets between stations which are or can be remote from each other. Conveyors of such type can be used in newspaper assembling and printing plants to transport newspaper sections from a printing or folding station to a gathering, inserting, mailing or storing station, from a storing station to a gathering, inserting or mailing station or between other stations. The conveyors are driven in synchronism with parts which serve to deliver objects at a printing, folding, storing or other station and with parts which serve to accept objects at a storing, inserting, gathering or other station. Since it is not always possible to advance the objects along a straight path, such conyeyors must often be designed in a manner to ensure that they can be advanced along helical, looped, arcuate or other more complex paths as well as that the objects can change their orientation during travel between two spaced-apart delivering and receiving stations. Moreover, the conveyors must be sufficiently sturdy to ensure that they can support a large number of objects, for example, if the delivering station is remote from the receiving station so that the path portion between such stations must accommodate a large number of objects.

A conveyor which is designed to transport sheets of paper or the like is disclosed, for example, in published PCT patent application No. WO 86/03476. The means for guiding the links of the chain includes a rail having a U-shaped cross-sectional outline. Such rails cannot be readily bent to define arcuate paths. It is even more difficult to twist a rail having a U-shaped cross-sectional outline. On the other hand, it is often necessary to advance sheets along a complex path having one or more arcuate portions and/or one or more helical portions. Bending of a rail having a U-shaped cross-sectional outline involves much time and must be carried out by resorting to complex machines, especially if it is desired to prevent changes of the profile as a result of bending or twisting.

OBJECTS OF THE INVENTION

An object of the invention is to provide a novel and improved conveyor which can be used to transport, either continuously or intermittently, short or long series of discrete sheets or groups of sheets along short, long, simple or complex paths and wherein the means for guiding the carriers of sheets or other objects is simpler and less expensive than the guide means of heretofore known conveyors.

Another object of the invention is to provide a novel and improved link chain for use as a means for transporting sheets or groups of sheets between spaced-apart delivering and receiving stations.

A further object of the invention is to provide a conveyor which need not employ guide rails having a U-shaped cross-sectional outline.

An additional object of the invention is to provide novel and improved tongs for use in the above outlined conveyor as a means for transporting discrete sheets or groups of sheets along straight, arcuate, helical and/or other paths.

Still another object of the invention is to provide a conveyor which can be used with advantage is a superior substitute for existing conveyors in newspaper printing plants and like establishments.

SUMMARY OF THE INVENTION

One feature of the present invention resides in the provision of a conveyor comprising a link chain which has a plurality of neighboring links, means for movably coupling the neighboring links to each other, and follower means on the links. The conveyor further comprises guide means for the follower means, and the guide means includes an elongated track having a central longitudinal axis and two symmetry planes which are normal to one another and intersect each other in the longitudinal axis.

The coupling means preferably comprises universal joints between neighboring links; each universal joint can constitute a Hook's coupling (also called cardan joint).

The track preferably includes a rail having an H-shaped cross-sectional outline and including a pair of spaced apart flanges or legs and a web between the flanges. Each flange has two lateral edge faces, and the follower means of each link preferably comprises four roller followers each of which tracks a different edge face. Each link can further comprise an additional or centering follower which is disposed at one side of the web between the two flanges of the rail.

The links can include alternating first and second links, and each first link preferably carries tongs. In other words, tongs can be provided on at least some of the links, and each tong preferably comprises a first jaw, a second jaw which is movable relative to the first jaw between a first end position adjacent the first jaw, a second end position remote from the first jaw and through a dead-center intermediate position between the first and second end positions. Each tongs further comprises means for biasing the second jaw to each of its end position. Still further, each tongs comprises means for moving the second jaw between its end positions. The first jaw of each tongs is or can be rigid with the respective link of the chain. The biasing means of each tongs can comprise a spring which stores energy during movement of the respective second jaw from either of its end positions toward the dead-center intermediate position and dissipates energy during movement of the second jaw from the dead-center intermediate position toward either end position. Each tongs can comprise a pivotable lever having a first arm which constitutes or includes the respective second jaw, a second arm which is biased by the respective spring, and a third arm which carries the respective moving means (such as a roller follower which can track stationary or mobile cams.

Another feature of the invention resides in the provision of tongs for use and conveyors for paper sheets and the like, particularly on chain conveyors of the above outlined type. The tongs comprises a first jaw, a second jaw which is movable relative to the first jaw between a first end position adjacent the first jaw, a second end position remote from the first jaw and through a dead-center intermediate position between the two end positions, and means for biasing the second jaw to each of its end positions. The tongs further comprises means for moving the second jaw between its end positions. Means (such as a chain link) can be provided for fixedly supporting the first jaw. The biasing means can comprise a spring which stores energy during movement of the second jaw from either of its end positions toward the dead-center intermediate position and dissipates energy during movement of the second jaw from the dead-center intermediate position toward either end position. The tongs can comprise a pivotable lever having a first arm which includes or constitutes the second jaw, a second arm which is acted upon by the spring, and a third arm which carries the moving means.

The novel features which are considered as characteristic of the invention are set forth in particular in the appended claims. The improved conveyor itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a fragmentary schematic elevational view of a conveyor which embodies the invention;

FIG. 3 is a sectional view substantially as seen in the direction of arrows from the line III—III of FIG. 2.

DESCRIPTION OF PREFERRED EMBODIMENTS

Figure 2:
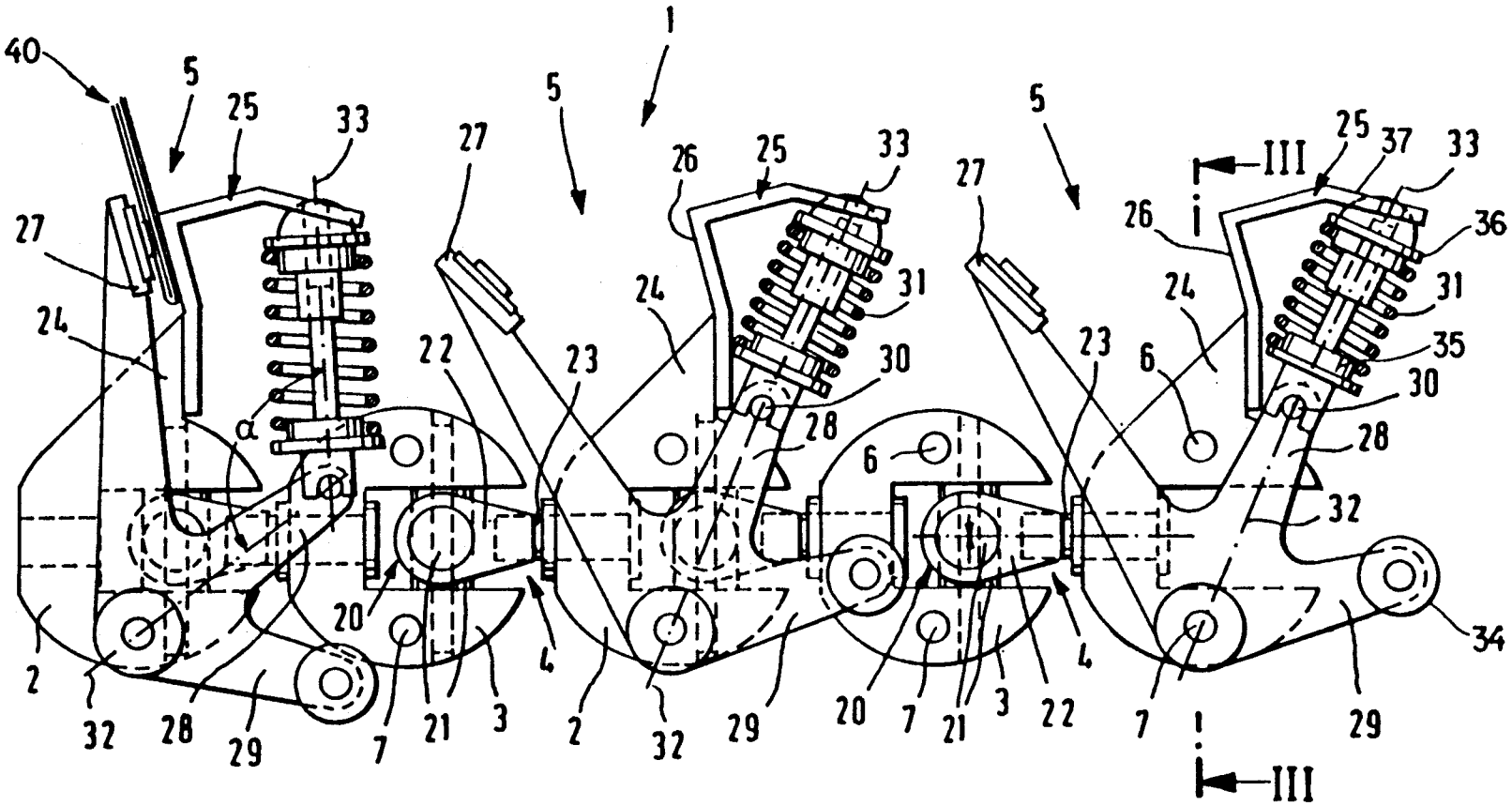
FIG. 2 is an enlarged view of a detail in the conveyor of FIG. 1.

The conveyor of FIGS. 1 to 3 comprises an endless link chain 1 having alternating first and second links 2, 3 which are articulately connected to each other by coupling means 4. Each coupling means 4 includes a universal joint 20, preferably a so-called Hook's coupling or cardan joint (FIG. 2). The links 2 carry grippers or tongs 5, and the links 3 serve as spacer means between neighboring tongs 5.

Each of the links 2, 3 carries two spaced apart parallel shafts 6 and 7 for pairs of roller followers 8, 9 (on the shaft 6) and 10, 11 (on the shaft 7). Distancing sleeves 12, 13 on the shafts 6 maintain the respective followers 8, 9 at a predetermined axial distance from each other, and similar distancing sleeves 14, 15 are provided on each shaft 7 to maintain the respective roller followers 10, 11 at a desired axial distance from one another. Each of the roller followers 8 to 11 is an idler roller.

The conveyor including the link chain 1 further comprises guide means including an elongated track 17 in the form of a rail having an H-shaped cross-sectional outline and including two spaced-apart parallel legs or flanges 16 and a web 16*a* between the flanges. The flanges 16 have pairs of lateral edge faces 16' which are tracked by the adjacent roller followers 8, 9, 10, 11 (see FIG. 3). The shaft 7 of each link 2 and of each link 3 carries a radially extending stud 18 for an additional roller follower 19 which is adjacent one side of the web 16*a* and is disposed between the flanges 16. The diameter of the additional follower 19 is only slightly less than the distance between the flanges 16 so that the links 2 and 3 are held against excessive movement relative to the rail 17 in the axial direction of their respective shafts 6 and 7. The additional follower 19 is an idler roller.

Each universal joint 20 comprises an intermediate block 21 with two pins disposed at right angles to each other. The block 21 is turnable about the longitudinal axis of the link chain 1. One pin of each block 21 is mounted in one of the adjacent links 2, 3 and the other pin of such block is connected with the prongs of a yoke or fork 22 which in turn, is rotatable about a stub 23 on the other link. The just described joints 20 enable the neighboring links 2, 3 to turn relative to each other about three different axes, namely about the axis of the stub 23 as well as about the axes of the two pins forming part of the respective block 21.

An important advantage of the improved conveyor is that it does not have to employ a rail having a U-shaped cross-sectional outline. Such U-rail is replaced with the rail 17 which has two symmetry planes A and B crossing each other at right angles in the central longitudinal axis of the rail 17. This rail can be much more readily twisted, bent, looped and/or otherwise deformed (without risking pronounced departure of the cross-sectional outline from that which is shown in FIG. 3) than a rail having a U-shaped cross-sectional outline.

Each link 2 has an outwardly projecting extension 24 which is rigid or integral with a bell crank lever 25. The radially inwardly extending arm 26 of the lever 25 constitutes a fixed first jaw or claw of the respective tongs 5. The movable second jaw 27 of each tongs 5 constitutes or forms part of a three-armed lever which is pivotally mounted on the shaft 7 of the respective link 2 and comprises two additional arms 28 and 29.

The second arm 28 of each three-armed lever carries a transversely extending pin 30 for a spring retainer 35. A second spring retainer 36 is mounted on the second arm 37 of the respective bell crank lever 25. A compression coil spring 31 operates between the retainers 35, 36 to permanently bias the arm 27 to either one of its two end positions as soon as the three-armed lever moves beyond a dead-center intermediate position in which the line 32 connecting the axis of the shaft 7 (pivot for the three-armed lever) and the axis of the respective pin 30 coincides with the axis 33 of the spring 31. When is the first end position (note the left-hand portion of FIG. 1), the jaw 27 is adjacent the first jaw 26 of the respective tongs 5. When in the second end position, the second jaw 27 is remote from the respective first jaw 26 and the arm 28 abuts the respective bell crank lever 25 (note the three-armed levers in the central and right-hand portions of FIG. 2). When in the intermediate position (close to the positions shown in the central and right-hand portions of FIG. 2), the jaw 27 is also spaced apart from the respective first jaw 26 and can be caused to move to either end position in response to leftward or rightward movement beyond the dead-center position.

The third arm 29 of each three-armed lever carries a roller follower 34 forming part of the means for moving the respective second jaw 27 between its end positions. The roller followers 34 cooperate with suitable stationary of mobile cam means (not shown) adjacent the path of movement of the links 2 to open or close the respective tongs 5 in predetermined portions of the path so that a tongs can grip a sheet or a group 40 of sheets during advancement past a first station and can release the sheet or the group of sheets during advancement past a second station. The angle alpha which is shown in the left-hand portion of FIG. 2 is defined by the line 32 and the axis 33 of the respective spring 31 when the corresponding second jaw 27 is maintained in the first end position and cooperates with the respective first jaw 26 to properly grip a sheet or a group 40 of sheets during movement along the path which is defined by the rail 17. Each spring 31 is caused to store energy during pivotal movement of the respective jaw 27 from either end position toward the dead-center intermediate position and is free to dissipate energy as soon as the jaw 27 moves (clockwise or counterclockwise) beyond the dead-center position. This ensures that the jaw 27 remains in the selected end position until and unless the respective roller follower 34 engages a cam or the like to compel the second jaw 27 to leave its end position and to pivot toward the dead-center position. Each roller follower 34 can comprise one or more idler rollers.

The improved link chain 1 and its grippers 5 can be used as a means for rapidly transporting sheets, panels or other relatively large square, rectangular or otherwise configurated objects (such as printed sheets, signatures, folded sheets, sections of newspapers or the like). For example, the chain 1 can be used to transport sections (40) of newspapers from a folding station or from a magazine to a gathering or inserting station. This can involve transport of sections (40) through considerable distances, e.g., from a printing plant to a mailing station and, if necessary, frequent changes of orientation of the links 2 and 3 on their way between such stations. The rail 17 cooperates with the followers 8–11 of the links 2 and 3 to ensure that the links can change their orientation in a highly predictable manner, and the tongs 5 ensure that the sections 40 are reliably held as long as necessary, i.e., until the respective followers 34 engage and are displaced by stationary cam means at the receiving station.

The springs 31 ensure that the movable jaws 27 are invariably urged to the one or the other end position in which the respective tongs 5 are open or closed. The bias of the springs 31 can be varied (if necessary) depending upon the number of sheets and the weight of sheets which are to be transported by the chain 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A conveyor, comprising a link chain having a plurality of neighboring links, means for movably coupling the neighboring links to each other, and follower means on said links; and guide means for said follower devices, including an elongated track having a central longitudinal axis and two symmetry planes normal to each other and crossing one another at said axis.

2. The conveyor of claim 1, wherein said coupling means comprises universal joints between neighboring links of said chain.

3. The conveyor of claim 1, wherein each of said joints is a Hook's coupling.

4. The conveyor of claim 1, wherein said track includes a rail having an H-shaped cross-sectional outline and including a pair of spaced-apart flanges and a web between said flanges, each of said flanges having two lateral edge faces and the follower devices of each of said links including four roller followers each engaging a different one of said edge faces.

5. The conveyor of claim 4, wherein each of said links further comprises an additional follower disposed at one side of said web between said flanges.

6. The conveyor of claim 1, wherein said links include alternating first and second links and further comprising tongs provided on said first links.

7. The conveyor of claim 1, further comprising tongs provided on at least some of said links, each of said tongs comprising a first jaw, a second jaw movable relative to the first jaw between a first end position adjacent the first jaw, a second end position remote from the first jaw and a dead-center intermediate position between the first and second end positions, and means for biasing the second jaw to each of said end positions.

8. The conveyor of claim 7, wherein each of said tongs further comprises means for moving the second jaw between said end positions.

9. The conveyor of claim 8, wherein the first jaw of each of said tongs is rigid with the respective link.

10. The conveyor of claim 8, wherein the biasing means of each of said tongs comprises a spring which stores energy during movement of the respective second jaw from either of the end positions toward said dead-center position and dissipates energy during movement of the respective second jaw from the dead-center position toward either of said end positions.

11. The conveyor of claim 10, wherein each of said tongs comprises a pivotable lever having a first arm constituting or including the respective second jaw, a second arm which is biased by said spring, and a third arm which carries said moving means.

12. Tongs for use on conveyors for paper sheets and the like, particularly on the links of chain conveyors, comprising a first jaw; a second jaw movable relative to said first jaw between a first end position adjacent said first jaw, a second end position remote from said first jaw, and a dead-center intermediate position between said end positions; and means for biasing said second jaw to each of said end positions, said biasing means including means for storing energy during movement of said second jaw from either of said end positions toward said dead-center position and for dissipating energy during movement of said second jaw from said dead-center position to either of said end positions.

13. The tongs of claim 12, further comprising means for moving said second jaw between said end positions.

14. The tongs of claim 13, further comprising means for fixedly supporting said first jaw.

15. Tongs for use on conveyors for paper sheets and the like, particularly on the links of chain conveyors, comprising a first jaw; a second jaw movable relative to said first jaw between a first end position adjacent said first jaw, a second end position remote from said first jaw, and a dead-center intermediate position between said end positions, said biasing means comprising a spring which stores energy during movement of the second jaw from either of said end positions toward said dead-center position and dissipates energy during movement of said second jaw from said dead-center position toward either of said end positions; and means for moving said second jaw between said end positions.

16. The tongs of claim 15, comprising a pivotable lever having a first arm including or constituting said second jaw, a second arm which is biased by said spring, and a third arm which carries said moving means.

* * * * *